US007165558B2

(12) United States Patent
Byun

(10) Patent No.: US 7,165,558 B2
(45) Date of Patent: Jan. 23, 2007

(54) MAKE-UP CASE HAVING PALLET

(76) Inventor: Young Kwang Byun, Mokdong Sinsigaji Apt. 928-1005, 312, Shinjung-Dong, Yangchun-Gu, Seoul (KR)

( * ) Notice: Subject to any disclaimer, the term of this patent is extended or adjusted under 35 U.S.C. 154(b) by 424 days.

(21) Appl. No.: 10/704,433

(22) Filed: Nov. 7, 2003

(65) Prior Publication Data

US 2005/0081878 A1 Apr. 21, 2005

(30) Foreign Application Priority Data

Oct. 16, 2003 (KR) ..... 20-2003-0032397 U

(51) Int. Cl.
*A45D 33/24* (2006.01)
*A45D 44/18* (2006.01)
*A45D 33/26* (2006.01)

(52) U.S. Cl. ..... 132/294; 132/313; 132/314

(58) Field of Classification Search ..... 132/294, 132/297, 317, 318, 73.5, 320, 73, 313, 314; 401/122, 126–129, 123–124, 18–19; 206/581, 206/823, 209, 81, 1.7, 1.8, 385; 220/408–410
See application file for complete search history.

(56) References Cited

U.S. PATENT DOCUMENTS 4,679,692 A * 7/1987 Davey ..... 206/581
5,135,112 A * 8/1992 Kamen et al. ..... 206/581
5,507,401 A * 4/1996 Huang ..... 215/12.1

FOREIGN PATENT DOCUMENTS

KR 0322302 8/2003

* cited by examiner

*Primary Examiner*—John J. Wilson
*Assistant Examiner*—Robyn Doan
(74) *Attorney, Agent, or Firm*—Baker Botts, LLP.

(57) ABSTRACT

A make-up case having pallet is disclosed. The make-up case includes: a body having a hollow tube, a latch locking part, and a lid; a pallet being in the form of a cylinder capable of being inserted into the body, the pallet having a number of compartments for containing cosmetics, latches, and a hollow part formed therein; and a painting tool coupled with the body, the painting tool having a grip, a brush holder, and a brush. A user can grasp the make-up case with one hand as it is in the form of a cylinder and has a small volume. The make-up case can be easily and safely carried and kept as it has a brush and a pallet and there is little possibility to expose the pallet by the small external impact due to screwing between the body and the pallet.

5 Claims, 7 Drawing Sheets

Prior Art

MAKE-UP CASE HAVING PALLET

BACKGROUND OF THE INVENTION

1. Field of the Invention

The present invention relates to a make-up case, and more particularly, to a make-up case having a pallet and a brush for containing cosmetics, such as lip gross, inside a cylindrical body.

2. Background of the Related Art

In general, most of people keep cosmetics in houses or offices, but according to circumstances, frequently carry and use cosmetics, such as lip gross. Studies of portable make-up cases capable of containing make-up tools and face-paints have been made. Korean Utility Model Registration No. 0322302 discloses a 'make-up case'. As shown in FIG. 3, the make-up case includes: a pallet 100 located inside a body 200, the pallet 100 having first and second compartments 110 and 120 for containing variable cosmetic materials and brushes, and a central portion 130 protruding between the first and second compartments 110 and 120; the body 200 containing the pallet 100, the body 200 having first and second lids 310 and 320 respectively hinged at both ends of the body 200 in an openable way for covering the first and second compartments 110 and 120 of the pallet 100; and a lid opening and closing unit 400 resiliently mounted between the pallet 100 and the body 200 for selectively opening and closing the first lid 310 or the second lid 320. The make-up case according to the prior art can contain various cosmetic tools and cosmetic materials, and reduce its volume. However, the make-up case is in a flat type like other conventional make-up cases, and so, a user can carry it by putting it inside a bag for cosmetics but may feel inconvenience when carrying it inside a pocket of pants. Additionally, the conventional make-up case has another problem in that the pallet is easily exposed to the outside by being opened even by the small external impact due to the structure opened by pressure of latches.

SUMMARY OF THE INVENTION

Accordingly, the present invention has been made to solve the above object, and it is an object of the present invention is to provide a make-up case having pallet, which a user can easily carry by putting it inside a pocket of pants due to small volume, and which can contain face-paints of various kinds and colors.

Another object of the present invention is to provide a make-up case having pallet, which can be safely kept and carried as not exposing a pallet by the external impact under unintended conditions.

To achieve these objects, in accordance with the invention, there is provided a make-up case having pallet including: a body having a latch locking part formed on the inner circumference of a hollow tube, and a lid of a round plate type mounted at the lower end thereof; a pallet having a number of cosmetic compartments made by forming concave grooves in the outer circumference of a cylindrical body thereof, latches formed at the lower end thereof to correspond to the latch locking part, and a hollow part formed inside the pallet, the cylindrical body being inserted into the body; and a painting tool coupled with the body, the painting tool having a grip formed at the upper portion thereof, a brush holder of a thin tube type, and a brush supported by the brush holder, the brush holder being inserted into the hollow part of the pallet.

It is preferable that the make-up case further includes a locking protrusion formed on the outer circumference of the brush holder and a locking protrusion formed on the inner circumference of the hollow part of the pallet so that the pallet rises when the painting tool is separated from the body and rises upwardly by the grip, the two locking protrusions corresponding to each other.

In another aspect of the present invention, there is also provided a make-up case having pallet including: a body having a latch locking part formed on the inner circumference of a hollow tube, and a lid of a round plate type mounted at the lower end thereof; a pallet having a number of cosmetic compartments made by forming concave grooves in the outer circumference of a cylindrical body thereof, latches formed at the lower end thereof to correspond to the latch locking part, a hollow part formed inside the pallet, the cylindrical body being inserted into the body, and a spring insertion hole formed between the cosmetic compartments and the hollow part, the spring insertion hole having a closed hole portion; a painting tool coupled with the body, the painting tool having a grip formed at the upper portion thereof, a brush holder of a thin tube type, and a brush supported by the brush holder, the brush holder being inserted into the hollow part of the pallet; and a spring supporter having a spring inserted into the spring insertion hole, the spring being restricted by the closed hole portion located on the upper end of the pallet, and a hollow tube formed integrally with the lid, the hollow tube having the same diameter as the spring to be inserted into the spring insertion hole together with the spring.

It is preferable that the body has a nut portion formed in the inner circumference of the upper portion thereof and the painting tool has a bolt portion formed on the central portion thereof, so that the body and the painting tool are screwed with each other.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

Figure 1A:
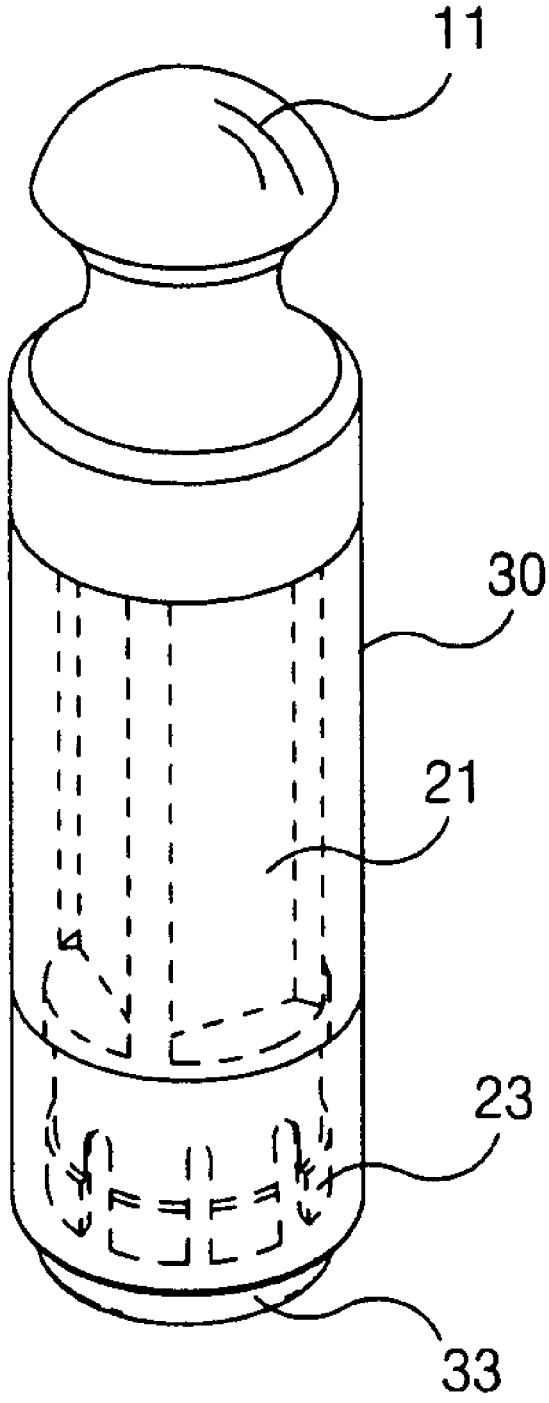
FIG. 1*a* is a perspective view showing an assembled state according to a preferred embodiment of the present invention.

FIG. 1*a* is a perspective view showing an assembled state according to a preferred embodiment of the present invention. As a make-up case having a pallet of the present invention is in the form of a cylinder and small in volume, a user can grasp it with one hand and conveniently carry it by putting it into a pocket of clothing, such as pants.

Figure 1B:
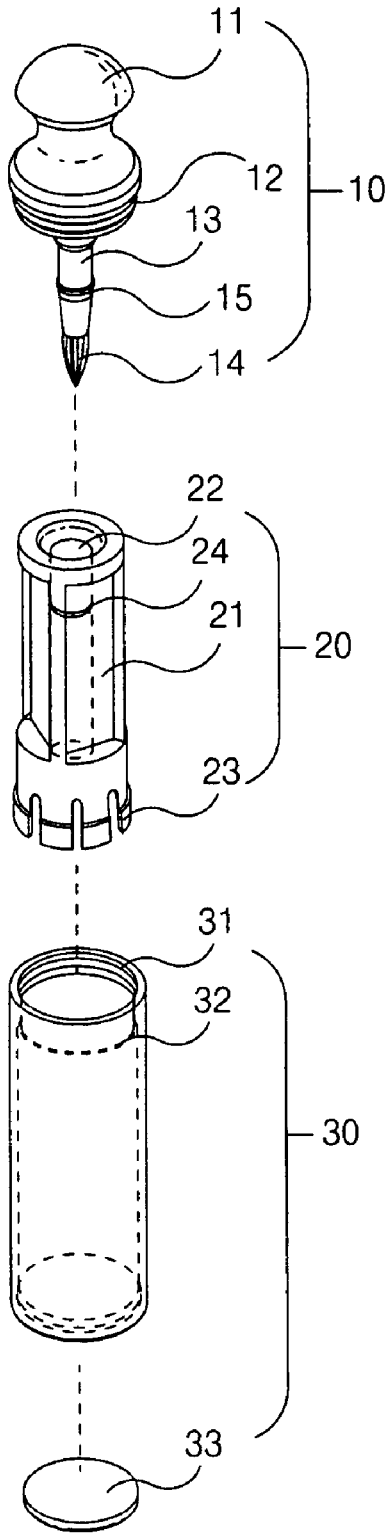
FIG. 1*b* is an exploded perspective view of FIG. 1*a;*

FIG. 1*b* is an exploded perspective view of FIG. 1*a*. In FIG. 1*b*, the make-up case includes a body 30, a pallet 20, and a painting tool 10. The body 30 is made with a cylindrical thin tube, and includes: a latch locking part 32 formed on the inner circumference thereof; and a lid 33 of a round plate formed at the bottom end thereof. The pallet 20 is in the form of a cylinder and can ascend and descend inside the body 30. The pallet 20 includes: a number of compartments 21 made by forming a number of concaves in the outer circumference of the pallet 20 for containing cosmetics; a hollow part 22 formed inside the pallet 20; and latches 23 formed at the bottom end thereof to correspond to the latch locking part 32 of the body 30, so that the pallet 20 can ascend and descend inside the body 30 but is prevented from being completely separated from the body 30. The painting tool 10 serves as a cap coupled to the body 30. The central portion of the painting tool 10 can be fit with the body 30, but to provide a tight sealability, as shown in the drawing, it is preferable that the body 30 has a nut portion 31 and the painting tool 10 has a bolt portion 12 to screw the nut portion 31 of the body 30 and the bolt portion 12 of the painting tool 10 with each other. The painting tool 10 includes: a brush holder 13 formed at the bottom thereof; a brush 14 supported by the brush holder 13, the brush holder 13 and the brush 14 being inserted into the hollow part 22 of the pallet 20; and a grip formed integrally with the brush 14 so as to allow the user to easily grasp it when painting the cosmetics using the brush 14.

Figure 1C:
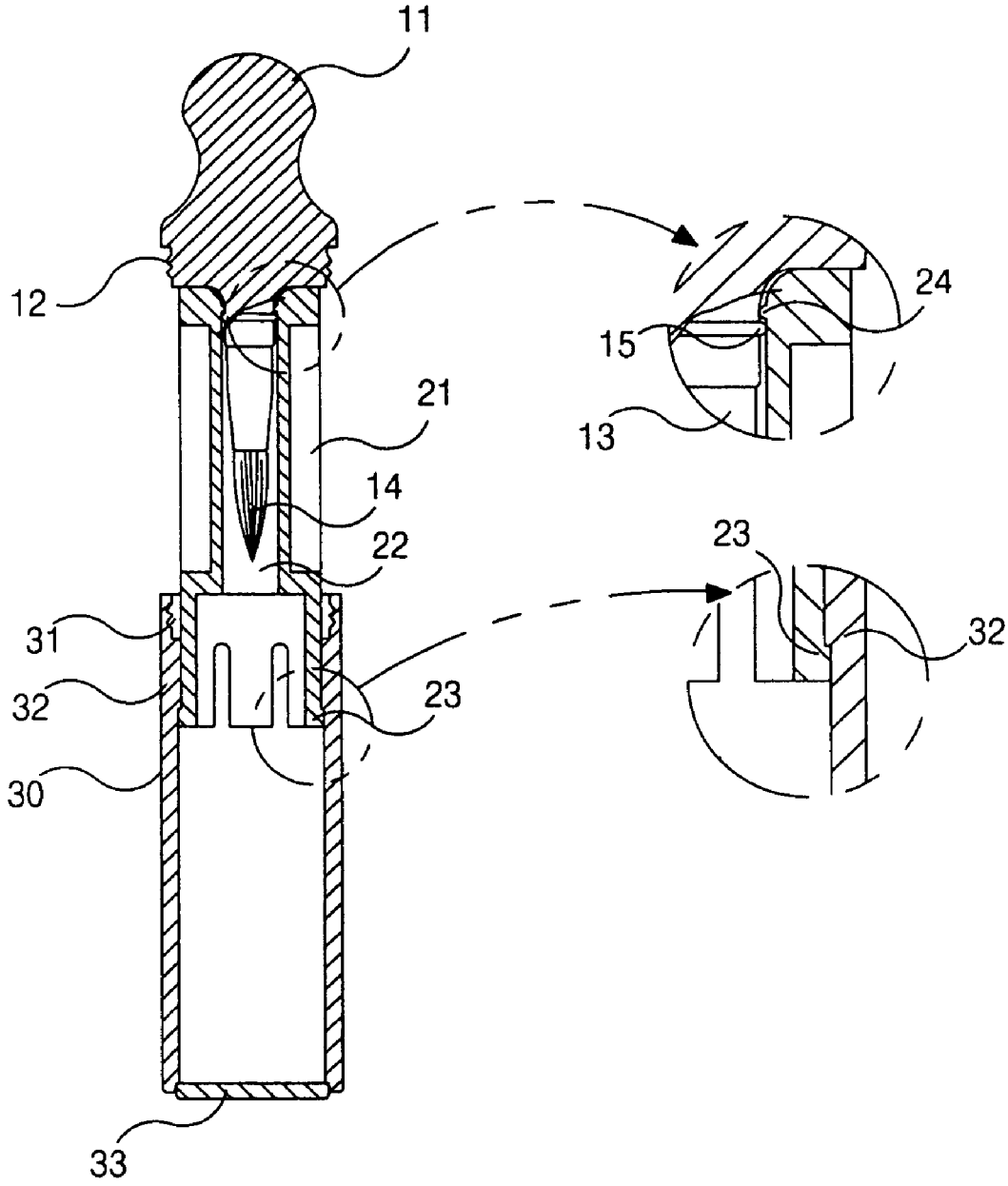
FIG. 1*c* is a vertically sectional view, which has partially enlarged views, showing a state in which a pallet of FIG. 1*a* rises.

Referring to FIG. 1*c*, functions of the present invention will be described as follows. To apply make-up, when the user pulls the grip 11 upwardly after loosening the coupling between the painting tool 10 and the body 30, a locking protrusion 15 of the painting tool 10, which is located at the underside, is locked to a locking protrusion 24 of the pallet 20, which is located at the upside, and so, the pallet 20 also rises upwardly. The pallet 20, which rises upwardly together with the painting tool 10, does not rise any more when the latches 23 are in contact with the latch locking part 32, thereby being prevented from complete separation. In this condition, when the user pulls the grip 11 with stronger power, the locking protrusion 15 of the painting tool 10 passes the locking protrusion 24 of the pallet 20, and then, the painting tool 10 is completely separated from the pallet 20. The user can paint the cosmetics contained in the pallet 20, which is in a rising condition, using the separated painting tool 10. To keep and carry the make-up case after the use, the brush holder 13 is inserted into the hollow part 22 till the two locking protrusions 15 and 24 are in contact with each other, and the pallet 20 is also lowered by the locking protrusions 15 and 24 when the user presses the grip 11 downwardly. The pallet 20 cannot be lowered any more when the lower end of the pallet 20 is in contact with the lid 33 of the body 30, and the locking protrusion 15 of the painting tool passes the locking protrusion 24 of the pallet 20 and is returned to its original condition when the user presses the grip 11 more. In this condition, the user couples the bolt portion 12 and the nut portion 31, and keeps or carries the make-up case.

Figure 2A:
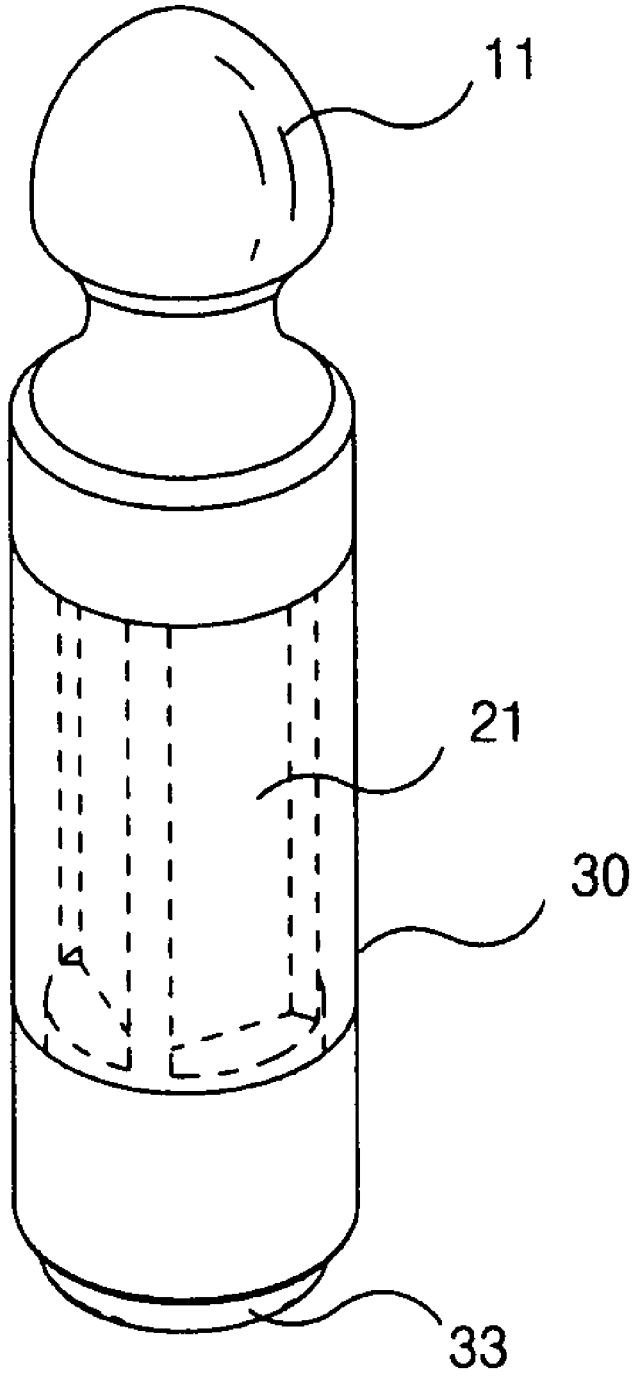
FIG. 2*a* is a perspective view showing an assembled state according to another preferred embodiment of the present invention.
Figure 2B:
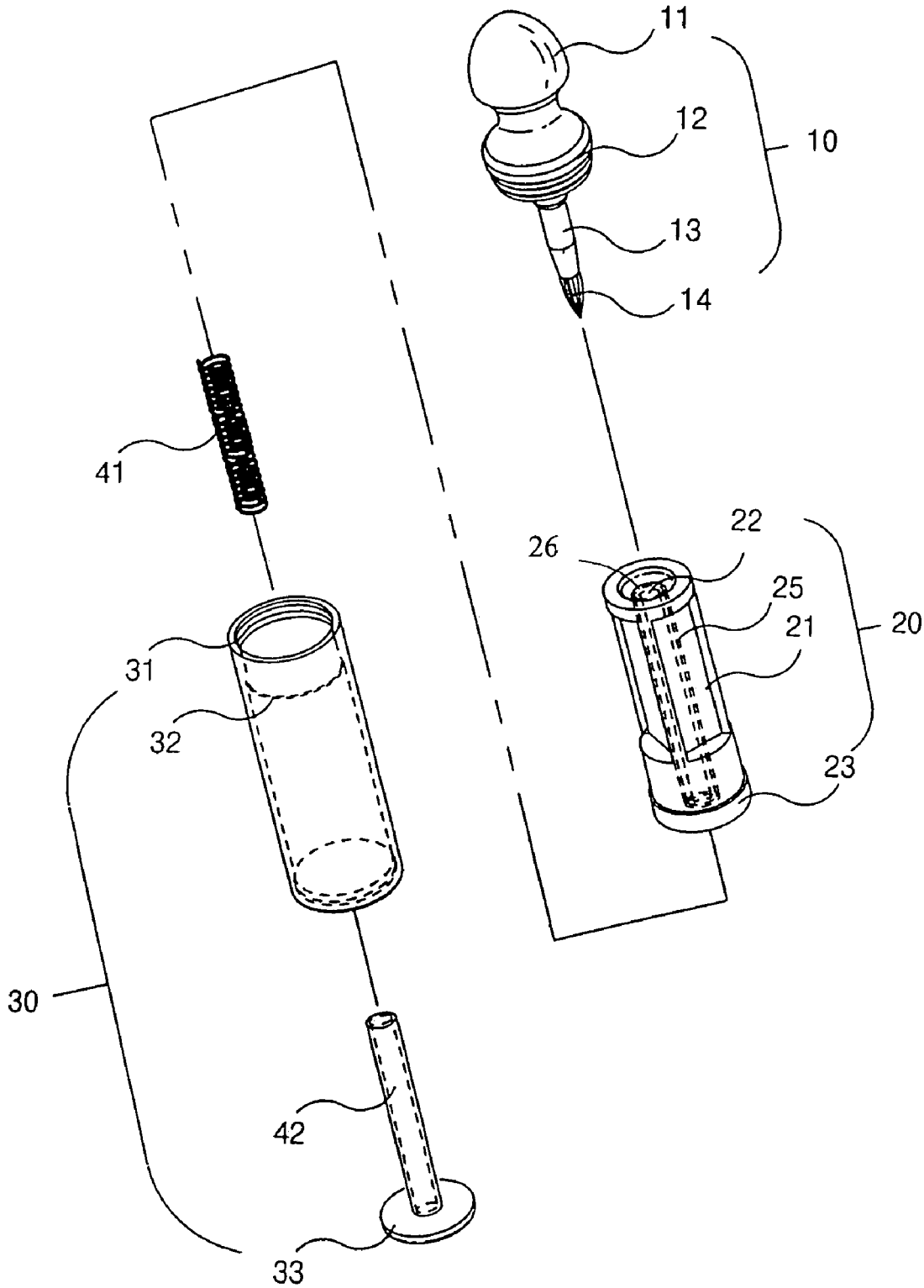
FIG. 2*b* is an exploded perspective view of FIG. 2*a;*
Figure 2C:
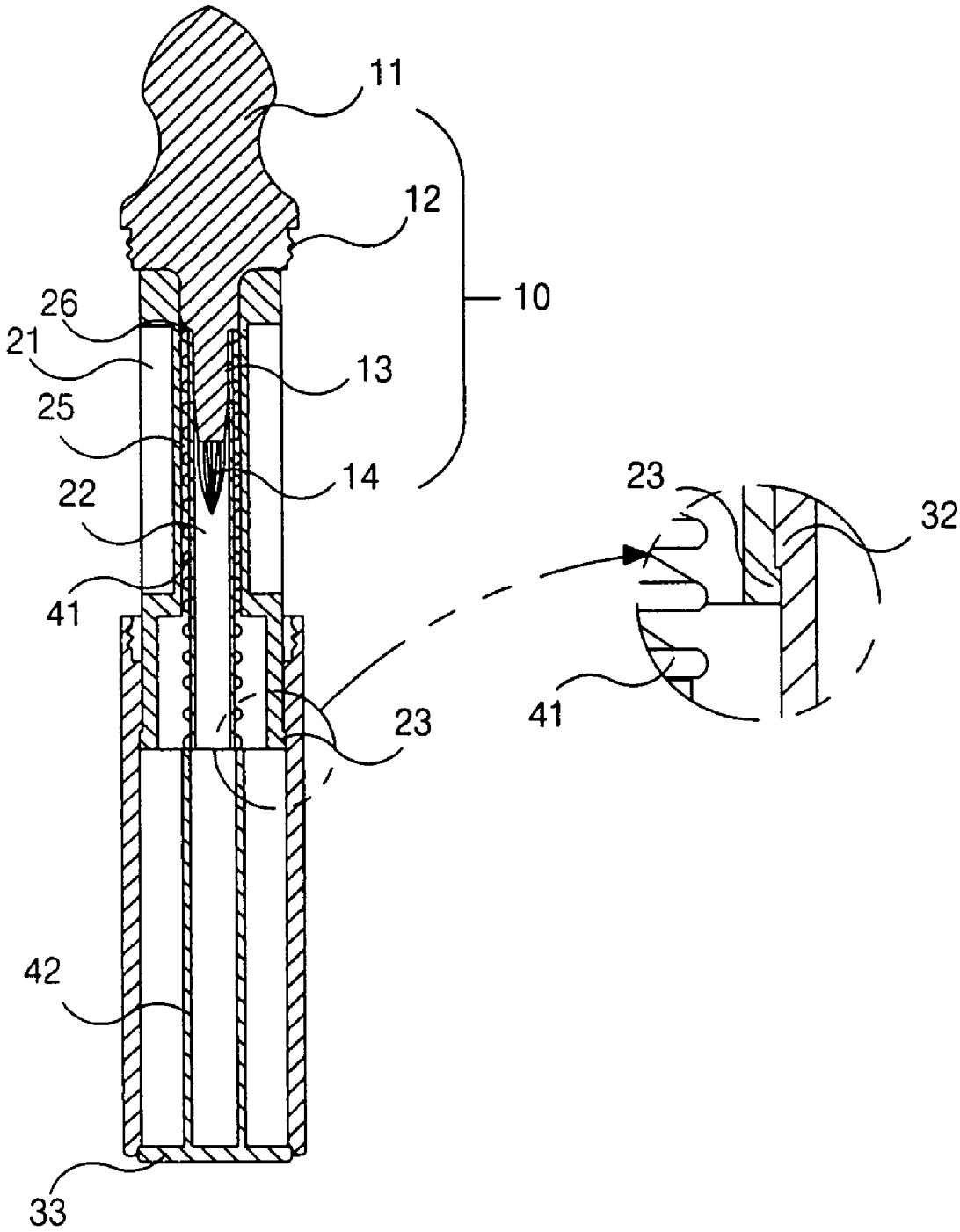
FIG. 2*c* is a vertically sectional view, which has partially enlarged views, showing a state in which a pallet of FIG. 2*a* rises.
Figure 3:
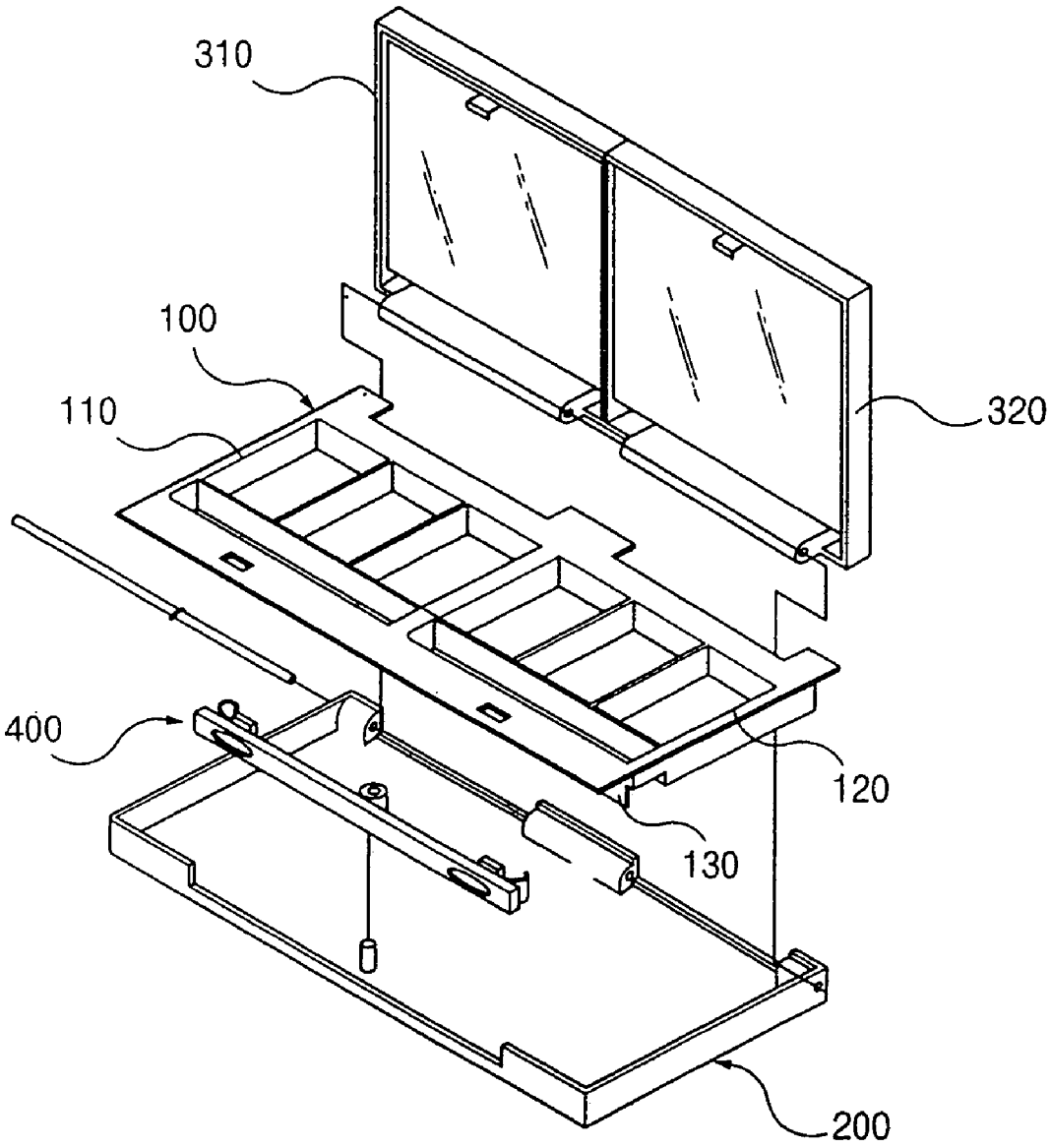
FIG. 3 is a perspective view of a conventional make-up case having a pallet.

FIGS. 2*a* to 2*c* are views showing another preferred embodiment of the present invention. Differently from the embodiment of FIGS. 1*a* to 1*c*, the embodiment of FIGS. 2*a* to 2*c* has a lifting structure by a spring 41. Therefore, description of the second embodiment corresponding to the first embodiment of FIGS. 1*a* to 1*c* will be omitted.

FIG. 2*a* is a perspective view showing an assembled state according to the second preferred embodiment of the present invention. There is little difference in the outward appearance between the second embodiment and the first embodiment in the assembled state.

FIG. 2*b* is an exploded perspective view of FIG. 2*a*. In FIG. 2*b*, the make-up case includes a body 30, a pallet 20, a painting tool 10, and a lifting structure, which has a spring 41 and a spring supporter 42. The spring supporter 42 is formed integrally with a lid 33 of the body 30, and in the form of a tube of the same diameter as the spring 41. The spring supporter 42 restricts the spring 41 at the lower portion. Furthermore, a spring insertion hole 25 of a larger diameter is formed between a hollow part 22 and a cosmetic compartment 21 of the pallet 20 on the same axis as the hollow part 22. A closed hole portion 26 is formed on the upper portion of the spring insertion hole 25 to restrict the spring 41 at the upside. Therefore, the spring 41 and the spring supporter 42, which are the same in diameter, can be inserted into the spring insertion hole 25.

Referring to FIG. 2*c*, a function of the second embodiment will be described as follows.

In a safe-keeping state or a carried state, the pallet 20 is lowered, and a nut portion 31 of the body 30 and a bolt portion 12 of the painting tool 10 are coupled with each other. In this condition, as described above, the spring 41 and the spring supporter 42 are all inserted into the spring insertion hole 25. To use the cosmetics, when the user releases the screwing between the body 30 and the painting tool 10, the spring 41 is loosened upwardly as the lower portion of the spring 41 is restricted by the spring supporter 42, so that the pallet 20 automatically rises upwardly. However, when latches 23 of the pallet 20 and a latch locking part 32 of the body 30 are in contact with each other, the pallet 20 does not rise any more. In a state in which the pallet 20 rises, the user can use the make-up case by lightly separating the painting tool 10 from the pallet 20 using a grip 11 of the painting tool 10. On the contrary, to keep the make-up case after the use, when the user presses the grip 11 downwardly, the spring 41 is contracted and inserted into the spring insertion hole 25 together with the spring supporter 42, and the body 30 and the painting tool 10 are screwed with each other by using the bolt portion 12 and the nut portion 31.

Therefore, the present invention can contain the pallet, which has a number of compartment parts, and the brush all together, and can be easily carried by being put in a pocket as it is a stick type. Moreover, the present invention is very economic as having a number of cosmetic compartment parts by forming concaves of various shapes inside the cylindrical pallet.

Additionally, the present invention can be safely carried by providing a more tightened sealability than conventional make-up cases of a button type as it is opened and closed by screwing.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A make-up case having pallet comprising:

a body having a latch locking part formed on the inner circumference of a hollow tube, and a lid of a round plate type mounted at the lower end thereof;

a pallet having a number of cosmetic compartments made by forming concave grooves in the outer circumference of a cylindrical body thereof, latches formed at the lower end thereof to correspond to the latch locking part, and a hollow part formed inside the pallet, the cylindrical body being inserted into the body; and a painting tool coupled with the body, the painting tool having a grip formed at the upper portion thereof, a brush holder of a thin tube type, and a brush supported by the brush holder, the brush holder being inserted into the hollow part of the pallet.

2. The make-up case according to claim 1, further comprising a locking protrusion formed on the outer circumference of the brush holder and a locking protrusion formed on the inner circumference of the hollow part of the pallet so that the pallet rises when the painting tool is separated from the body and rises upwardly by the grip, the two locking protrusions corresponding to each other.

3. A make-up case having pallet comprising:

a body having a latch locking part formed on the inner circumference of a hollow tube, and a lid of a round plate type mounted at the lower end thereof;

a pallet having a number of cosmetic compartments made by forming concave grooves in the outer circumference of a cylindrical body thereof, latches formed at the lower end thereof to correspond to the latch locking part, a hollow part formed inside the pallet, the cylindrical body being inserted into the body, and a spring insertion hole formed between the cosmetic compartments and the hollow part, the spring insertion hole having a closed hole portion;

a painting tool coupled with the body, the painting tool having a grip formed at the upper portion thereof a brush holder of a thin tube type, and a brush supported by the brush holder, the brush holder being inserted into the hollow part of the pallet; and a spring supporter having a spring inserted into the spring insertion hole, the spring being restricted by the closed hole portion located on the upper end of the pallet, and a hollow tube formed integrally with the lid, the hollow tube having the same diameter as the spring to be inserted into the spring insertion hole together with the spring.

4. The make-up case according to claim 1, wherein the body has a nut portion formed in the inner circumference of the upper portion thereof and the painting tool has a bolt portion formed on the central portion thereof, so that the body and the painting tool are screwed with each other.

5. The make-up case according to claim 3, wherein the body has a nut portion formed in the inner circumference of the upper portion thereof and the painting tool has a bolt portion formed on the central portion thereof, so that the body and the painting tool are screwed with each other.

* * * * *